US010563334B2

(12) United States Patent
Wei

(10) Patent No.: US 10,563,334 B2
(45) Date of Patent: Feb. 18, 2020

(54) WASHING MACHINE

(71) Applicant: Hsao-Tsung Wei, New Taipei (TW)

(72) Inventor: Hsao-Tsung Wei, New Taipei (TW)

( * ) Notice: Subject to any disclaimer, the term of this patent is extended or adjusted under 35 U.S.C. 154(b) by 0 days.

(21) Appl. No.: 16/114,238

(22) Filed: Aug. 28, 2018

(65) Prior Publication Data

US 2018/0363189 A1 Dec. 20, 2018

Related U.S. Application Data

(63) Continuation-in-part of application No. 15/353,701, filed on Nov. 16, 2016, now abandoned.

(51) Int. Cl.

| | |
|---|---|
| ***D06F 39/12*** | (2006.01) |
| ***D06F 23/04*** | (2006.01) |
| ***D06F 39/08*** | (2006.01) |
| ***D06F 37/30*** | (2020.01) |
| ***D06F 37/12*** | (2006.01) |
| ***D06F 37/14*** | (2006.01) |
| *D06F 17/10* | (2006.01) |

(52) U.S. Cl.

CPC ..... *D06F 23/04* (2013.01); *D06F 37/12* (2013.01); *D06F 37/145* (2013.01); *D06F 37/304* (2013.01); *D06F 39/083* (2013.01); *D06F 17/10* (2013.01); *D06F 37/14* (2013.01)

(58) Field of Classification Search

None

See application file for complete search history.

(56) References Cited

U.S. PATENT DOCUMENTS

2008/0141732 A1* 6/2008 Leidig ..... D06F 37/14 68/13 R
2018/0142400 A1* 5/2018 Zhu ..... D06F 37/225

FOREIGN PATENT DOCUMENTS

CN 2474560 Y * 1/2002
CN 106048981 A * 10/2016
EP 3018247 A1 * 5/2015

OTHER PUBLICATIONS

English machine translation of CN106048981A and CN2474560Y.*

* cited by examiner

*Primary Examiner* — Michael E Barr
*Assistant Examiner* — Jason P Riggleman
(74) *Attorney, Agent, or Firm* — Leong C. Lei

(57) ABSTRACT

A washing machine has a number of functional plates detachably plugged to an inner wall surrounding a washing space of a basket of the washing machine. The inner wall also has a number of spiral drainage ducts connected to an annular recess adjacent to a top opening of the basket. A number of through openings are configured in the annular recess. A rotatable agitation disc is detachably mounted on a bottom side of the basket. The washing machine has no dirt accumulation problem between inner and outer baskets. Its various components are easily detachable and the washing machine therefore is constantly maintained in a clean and sanitary state.

4 Claims, 5 Drawing Sheets

WASHING MACHINE

CROSS-REFERENCE

This is continuation-in-part of the co-pending patent application Ser. No. 15/353,701, filed Nov. 16, 2016.

BACKGROUND OF THE INVENTION

(a) Technical Field of the Invention

The present invention is generally related to domestic washing machines.

(b) Description of the Prior Art

Commercially available washing machines often have an inner basket (or drum) for holding clothes contained within an outer basket for holding water. Dirt is easily accumulated in the space between the baskets, breeding bacteria and foul matters, and cannot be removed unless the washing machine is dismantled and cleaned.

SUMMARY OF THE INVENTION

The present invention provides a novel washing machine having a single internal container for holding both clothes and water so that there is no dirt accumulation problem that is often found in the prior art washing machines. The internal container has an inner wall that includes various easily detachable functional plates and is formed with spiral channels to achieve both enhanced washing and spin-drying performances. The washing machine can be constantly maintained in a clean and sanitary state.

The foregoing objective and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1A:
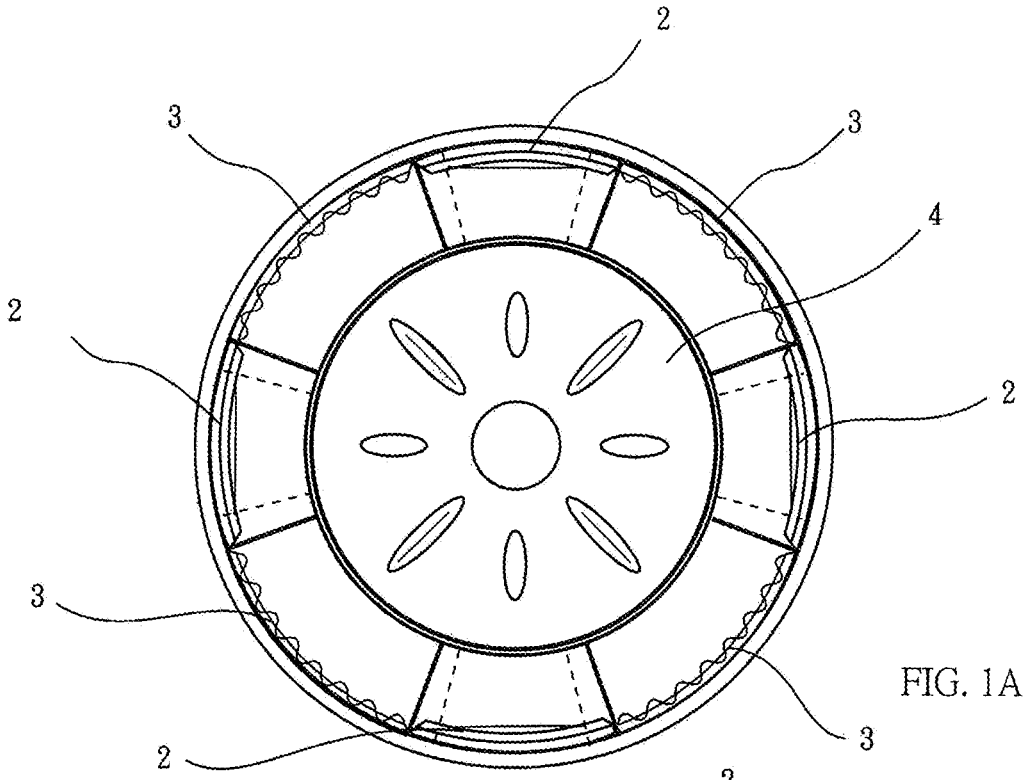
FIG. 1A is a top plan view showing an internal container with functional plates installed according to the present invention.
Figure 1B:
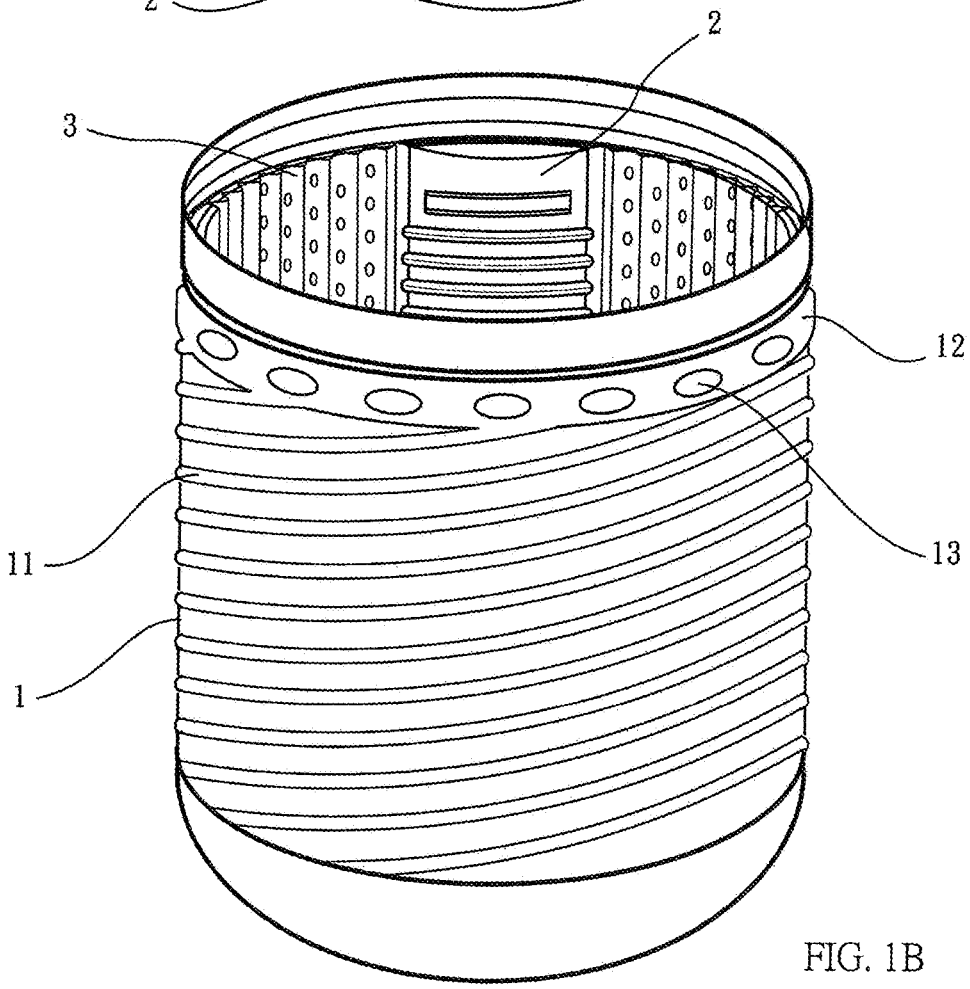
FIG. 1B is a perspective view showing the container of FIG. 1A.
Figure 2A:
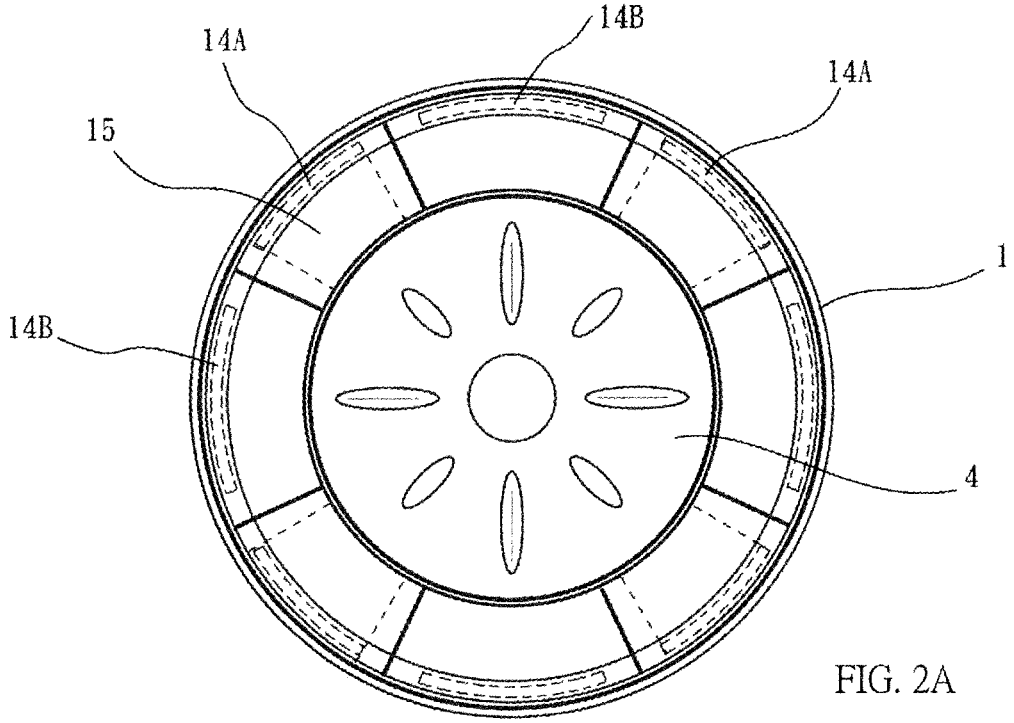
FIG. 2A is another top plan view showing the container of FIG. 1 without functional plates.
Figure 2B:
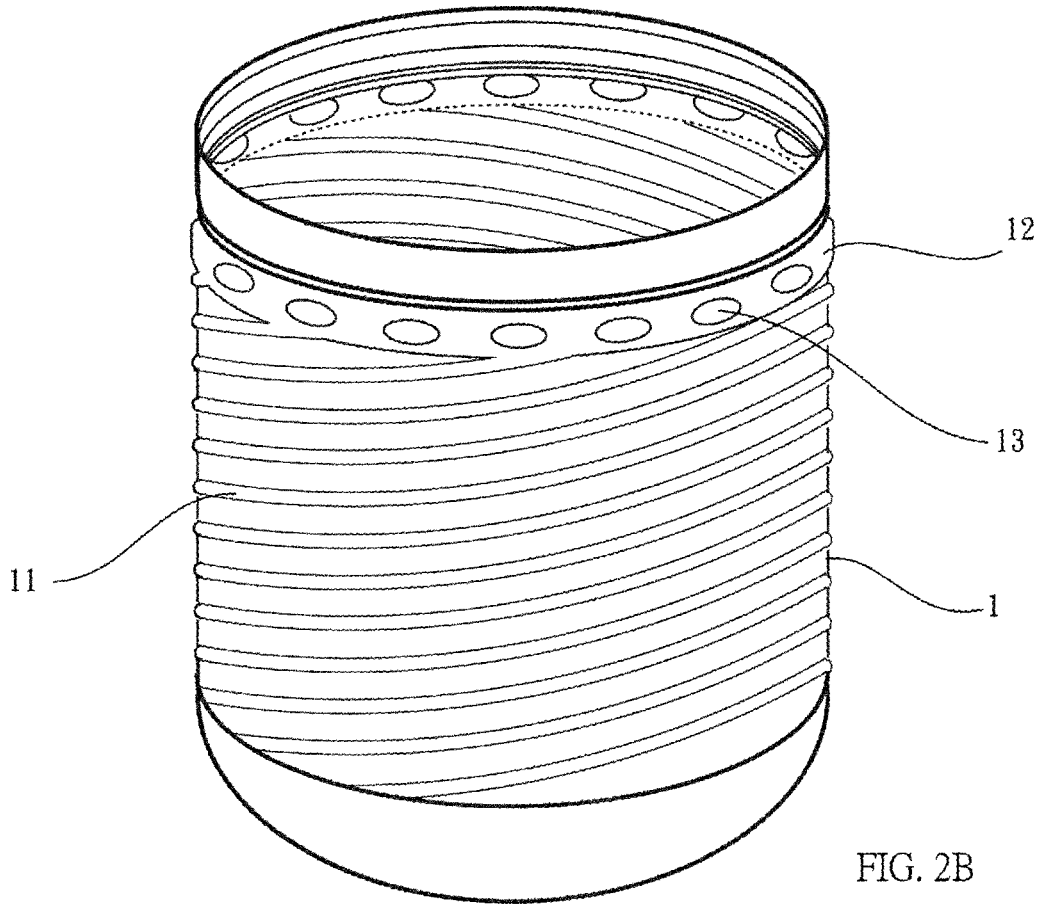
FIG. 2B is a perspective view showing the container of FIG. 2A.
Figure 3:
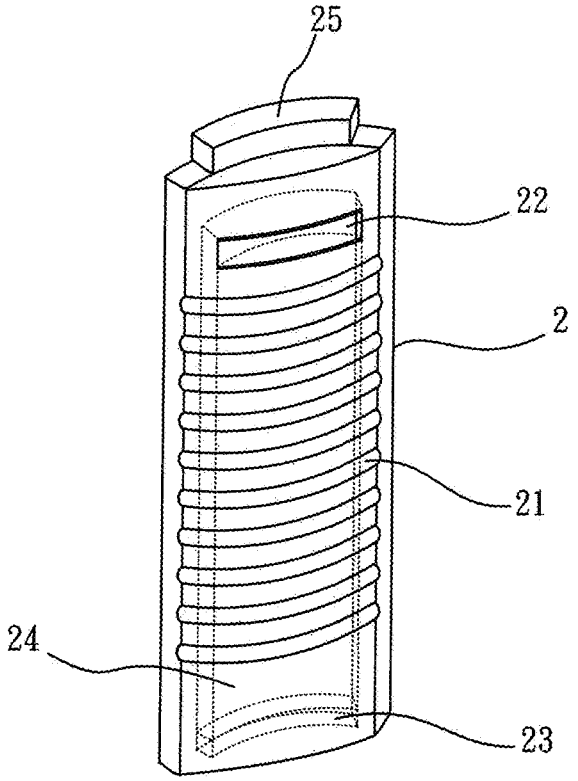
FIG. 3 is a perspective view showing a washer plate according to the present invention.
Figure 4:
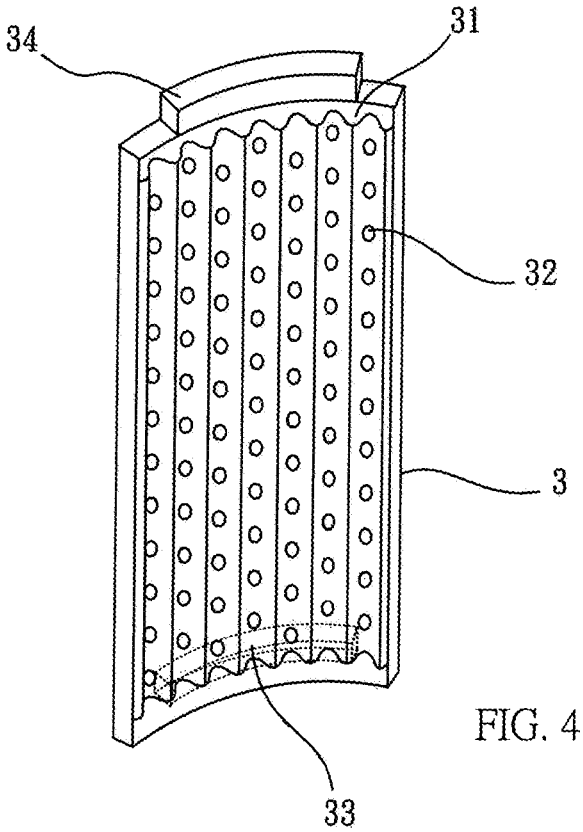
FIG. 4 is a perspective view showing a wave plate according to the present invention.
Figure 5A:
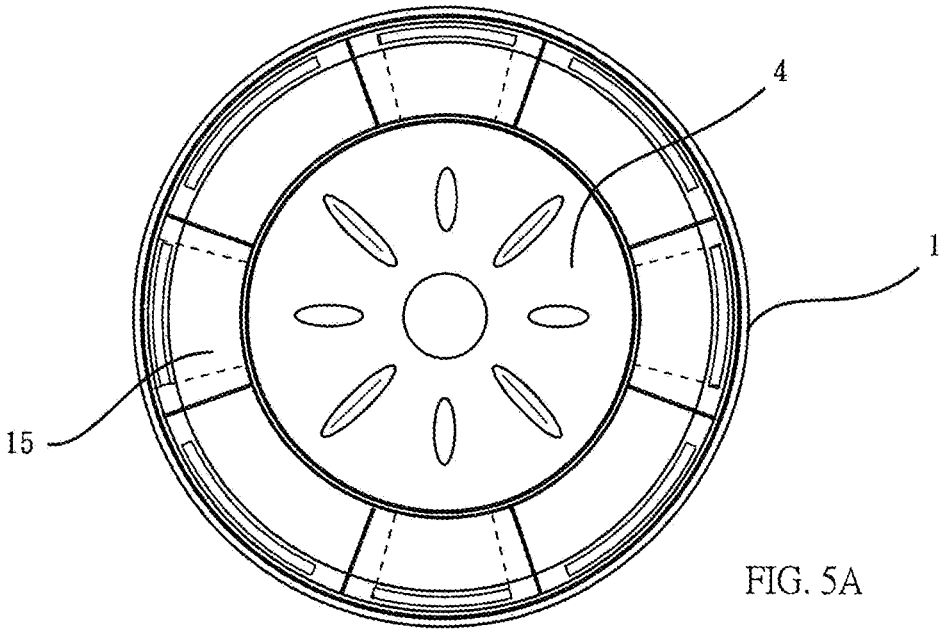
FIG. 5A is a top plan view showing an agitation disc mounted in the container of FIGS. 1A and 1B.
Figure 5B:
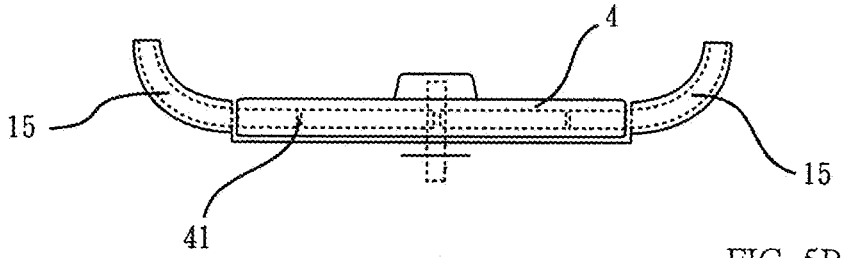
FIG. 5B is a schematic sectional view showing the agitation disc of FIG. 5A.
Figure 6A:
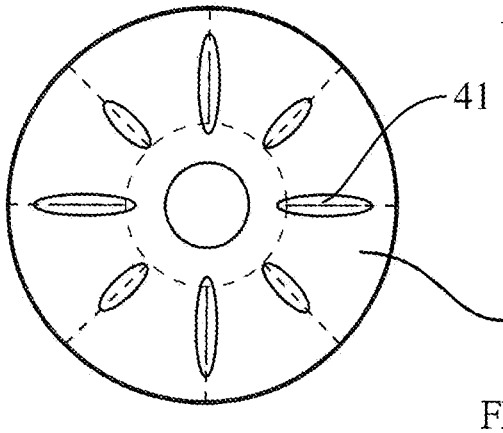
FIG. 6A is another top plan view showing the agitation disc of FIG. 5A alone.
Figure 6B:
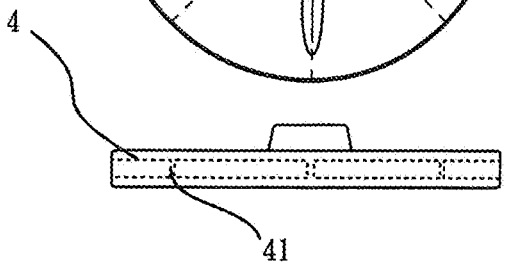
FIG. 6B is a schematic side view of the agitation disc of FIG. 6A.
Figure 7A:
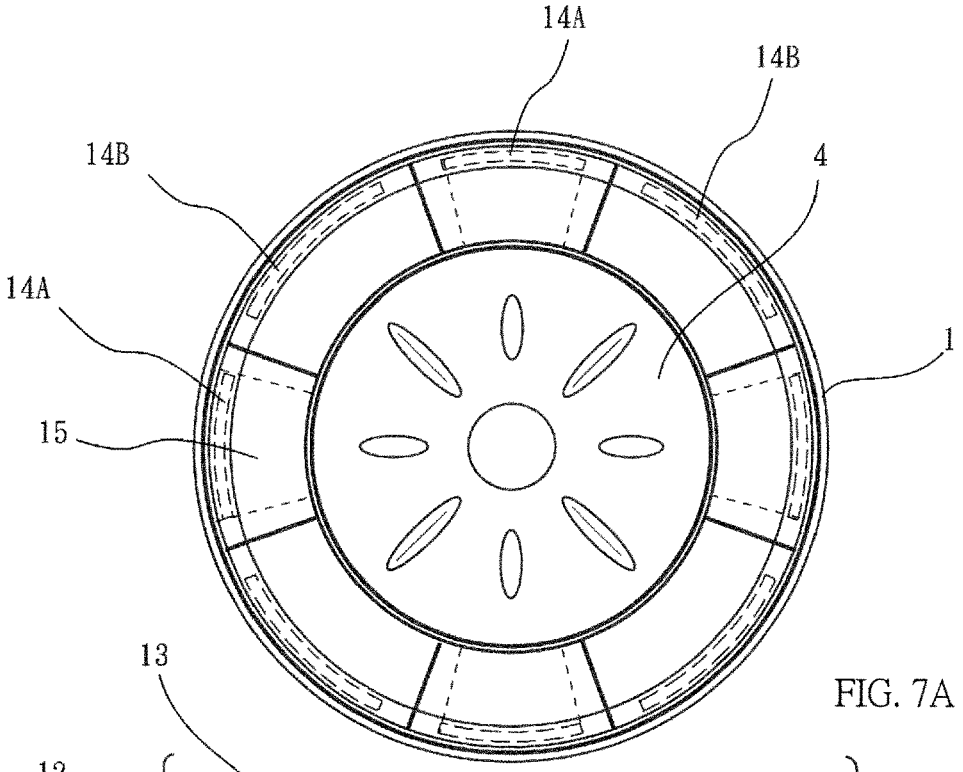
FIG. 7A is a top plan view showing a washing machine according to an embodiment of the present invention.
Figure 7B:
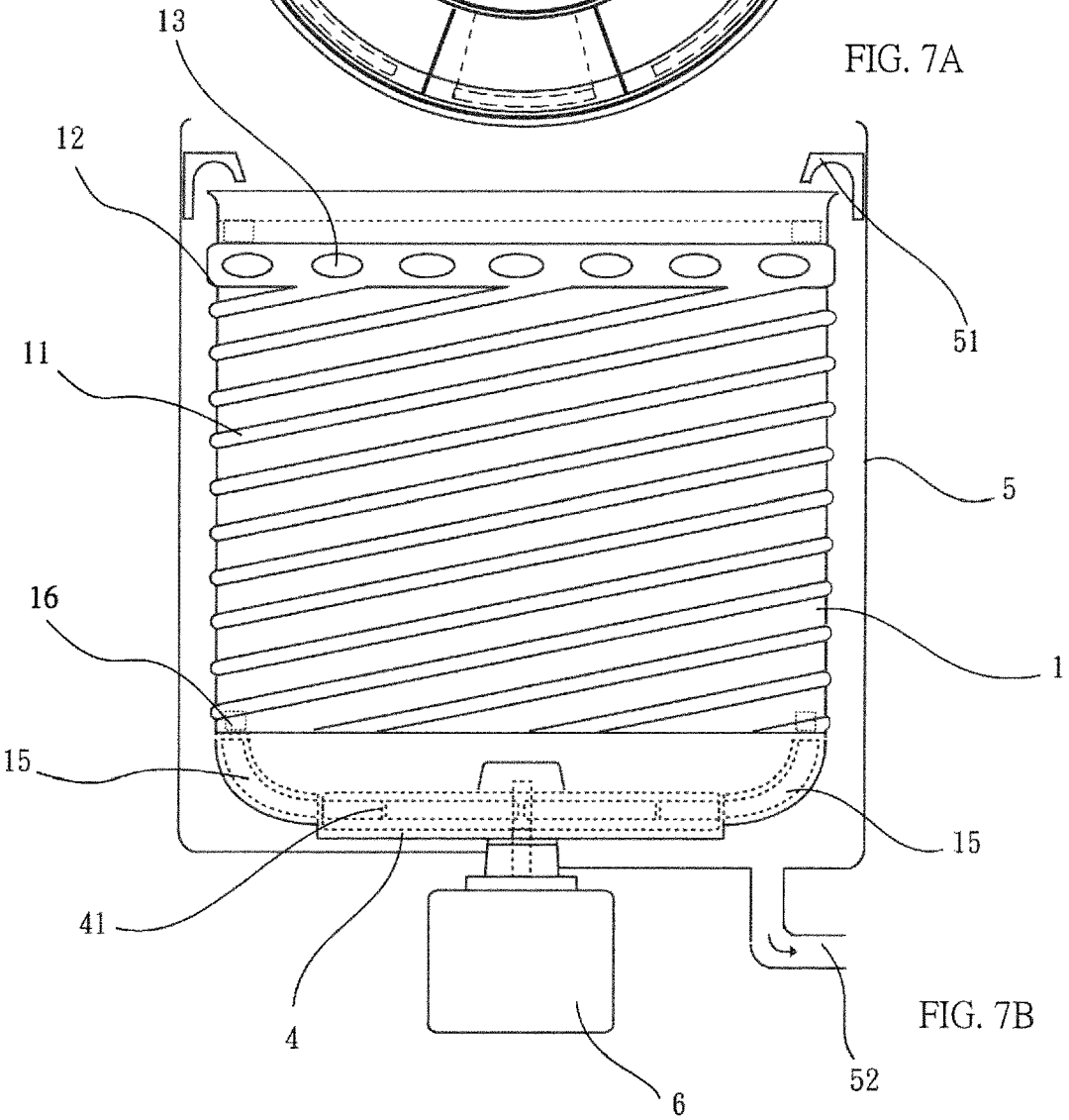
FIG. 7B is a schematic sectional view showing the washing machine of FIG. 7A.

FIG. 7A is a top plan view showing a washing machine according to an embodiment of the present invention. FIG. 7B is a schematic sectional view showing the washing machine of FIG. 7A. As shown, the washing machine according to the present invention comprises a tub 5 having a container space and a bottom side provided with an outlet pipe 52 connecting the container space to the outside of the tub 5. An internal container 1 (see FIGS. 2A and 2B) is mounted in the container space of the tub 5 for holding and washing clothes. The tub 5 may be of various shapes and has a space to receive the container 1. The container 1 is cylindrical in shape and has a hollow space inside. The container 1 has an open top 101 and an inner wall 102. As shown in FIGS. 1A, 1B, 3 and 4, a plurality of washing plates 2 and a plurality of wavy plates 3 are mounted on the inner wall 102 of the container 1. A plurality of spiral flow channels 11 are arranged on the inner wall 102 of the container 1. The spiral flow channels 11 are concaved into the inner wall 102 of the container 1 in a direction for a depth which gradually increases as the spiral flow channels 11 are extended from the bottom of the container 1 to the top of the container 1. The spiral flow channels 11 are slanted for at least 30 degrees on the inner wall 102 of the container 1. The spiral flow channels 11 are all connected to an annular recess 12 which is formed on the inner wall 102 of the container 1 and located close to the open top 101 of the container 1. The spiral flow channels 11 are preferably formed by stamping. The annular recess 12 is provided with a plurality of through openings 13. The container 1 has a plurality of slots 14A and 14B spaced around the inner wall 102 of the container 1 and located close to the open top 101 of the container 1 and above the annular recess 12. Further, the container 1 has a plurality of latches 16 spaced apart on the inner wall 102 of the container 1 and located close to the bottom of the container 1 (see FIGS. 7A and 7B). As shown in FIGS. 3 and 4, a plurality of washing plates 2 are arranged on the inner wall 102 of the container 1. The washing plate 2 is a hollow member having a plurality of horizontal ribs 21 on an outer side of the washing plate 2 and an outlet opening 22 in communication with the inner space 24 of the washing plate 2 and close to the upper end of the washing plate 2. The upper end of the washing plate 2 is provided with a latch 25 and the lower end of the washing plate 2 is provided with a slot 23. The washing plate 2 is arranged on the inner wall 102 of the container 1, with the latch 25 of the washing plate 2 engaged with a respective one of the slots 14A of the container 1 and the slot 23 of the washing plate 2 with a respective one of the latches 16 of the container 1. As shown in FIGS. 3 and 4, a plurality of wavy plates 2 are arranged on the inner wall 102 of the container 1. The wavy plate 2 has a plurality of vertical wave elements 31 on the outer side of the wavy plate 2. The vertical wave element 31 is provided with a plurality of through holes 32 for spin-drying. The upper end of the wavy plate 3 is provided with a latch 34 and the lower end of the wavy plate 3 is provided with a slot 33. The wavy plate 3 is arranged on the inner wall 102 of the container 1, with the latch 34 of the wavy plate 3 engaged with a respective one of the slots 14B of the container 1 and with the slot 33 of the wavy plate 3 engaged with a respective one of the latches 16 of the container 1. The washing plates 2 and the wavy plates 3 are alternately mounted on the inner wall 102 of the container 1, with a gap between washing plates 2 and the inner wall 102 of the container 1 and with a gap between the wavy plates 3 and the inner wall 102 of the container 1.

A rotatable agitation disc 4 is mounted on the inner bottom side of the container 1 and mounted on a vertical axle of the motor 6 (see FIG. 7B). The rotatable agitation disc 4 has a plurality of radially arranged fins 41. The outer bottom of the container 1 is provided with a plurality of connecting ducts 15 (see FIGS. 5A, 5B, 7A and 7B) aiming at the circumference of the rotatable agitation disc 4. Around the edge of the top opening of the tub 5, there is an anti-spray member 51 to prevent water from spraying out of the tub 5.

The outlet 22 of the washer plate 2 may be provided with a filter (not shown) for filtering out debris and particles. Further, the washer plate 2 may be a solid member and has no inner space.

In operation, when the power of the motor 6 is turned on, the motor 6 will cause the rotatable agitation disc 4 to rotate which in turn drives water in the container 1 to flow and circulate. As a consequence, the clothes inside the container 1 will be spun by the circulating water thereby causing the clothes to rub against the horizontal ribs 21 of the washer plates 2 and the vertical wave elements 31 of the wavy plate 3 and therefore achieving greater cleaning effect. After the washing machine is operated for a period of time, debris and particles will be accumulated on the first and second plates 2 and 3. According to the present invention, the washing plates 2 and the wavy plates 3 can be easily detached from the container 1 for cleaning. As such, the washing machine according to the present invention can be constantly maintained in a clean and sanitary state.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A washing machine, comprising a tub having a container space and a bottom, said bottom being provided with an outlet pipe connecting said container space to outside of said tub;

a motor mounted beneath said bottom of said tub;

a container housed in said container space of said tub, said container having a cylindrical shape with a hollow space inside, said container having an open top and an inner wall having a bottom end, said inner wall of said container having a plurality of spiral flow channels which are concaved into said inner wall in a direction for a depth which gradually increases as said spiral flow channels are extended from the bottom end of said inner wall of said container to an upper part of said inner wall of said container, said container having an annular recess formed on said inner wall and located above said spiral flow channels and close to said open top, said container having a plurality of slots spaced apart on said inner wall and located close to said open top and a plurality of latches spaced apart on said inner wall and located close to the bottom end of said inner wall of said container;

a plurality of washing plates arranged on said inner wall of said container, said washing plates being a hollow member and having an inner space, said washing plates having an outer side provided with a plurality of horizontal ribs, an upper end of said washing plates being provided with a latch, a lower end of said washing plates being provided with a slot, said washing plates being detachably mounted on said inner wall of said container with said latch of said washing plates engaged with a respective one of said slots of said container and with said slot of said washing plates engaged with a respective one of said latches of said container;

a plurality of wavy plates arranged on said inner wall of said container, said wavy plates having an outer side provided with a plurality of vertical wave elements, said vertical wave elements being provided with through holes, an upper end of said wavy plates being provided with a latch, an lower end of said wavy plates being provided with a slot, said wavy plates being detachably mounted on said inner wall of said container with said latch of said wavy plates engaged with a respective one of said slots of said container and with said slot of said wavy plates engaged with a respective one of said slots of said container;

a rotatable agitation disc mounted at the bottom end of said inner wall of said container, said rotatable agitation disc being vertically mounted on a vertical axle of said motor, said rotatable agitation disc having a plurality of radially arranged fins; and a plurality of connecting ducts arranged to have one end of each of the plurality of connecting ducts mounted to the bottom end of said inner wall of said container and an opposite end facing a circumference of said rotatable agitation disc;

wherein said motor is operable to cause said rotatable agitation disc to rotate such that the rotatable agitation disc drives water in said container to flow and circulate with the radially arranged fins and clothes inside said container are spun by the circulating water flow to rub against said horizontal ribs of said washing plates and said vertical wave elements of said wavy plate.

2. The washing machine according to claim 1, wherein the spiral flow channels are slanted for at least 30 degrees.

3. The washing machine according to claim 1, wherein the spiral flow channels are formed by stamping.

4. The washing machine according to claim 1, wherein said washing plates and said wavy plates are alternately positioned along said inner wall of said basket.

* * * * *